US010107247B2

(12) United States Patent
Cavanagh

(10) Patent No.: US 10,107,247 B2
(45) Date of Patent: Oct. 23, 2018

(54) METHOD OF SUPPRESSING CAVITATION IN A FUEL INJECTOR

(71) Applicant: Stanadyne LLC, Windsor, CT (US)

(72) Inventor: Mark S. Cavanagh, West Granby, CT (US)

(73) Assignee: Stanadyne LLC, Windsor, CT (US)

( * ) Notice: Subject to any disclaimer, the term of this patent is extended or adjusted under 35 U.S.C. 154(b) by 191 days.

(21) Appl. No.: 14/979,994

(22) Filed: Dec. 28, 2015

(65) Prior Publication Data

US 2016/0115928 A1 Apr. 28, 2016

Related U.S. Application Data

(62) Division of application No. 13/792,622, filed on Mar. 11, 2013, now Pat. No. 9,291,134.

(51) Int. Cl.

| | |
|---|---|
| ***F02M 63/00*** | (2006.01) |
| ***F02M 47/02*** | (2006.01) |
| ***F02M 61/10*** | (2006.01) |
| ***F02M 61/12*** | (2006.01) |

(52) U.S. Cl.

CPC ..... *F02M 63/0056* (2013.01); *F02M 47/027* (2013.01); *F02M 61/10* (2013.01); *F02M 61/12* (2013.01); *F02M 63/0005* (2013.01); *F02M 2200/04* (2013.01); *F02M 2200/28* (2013.01)

(58) Field of Classification Search

CPC ..... F02M 63/0225; F02M 47/02; F02M 63/0003; F02M 61/06; F02M 47/025; F02M 63/0005; F02M 63/0007; F02M 63/0008; F02M 63/04; F02M 63/0054; F02M 47/027; F02M 63/0035; F02M 55/008; F02M 61/10; F02M 2200/02; F02M 2200/04; F02M 2200/28; F02M 63/0056; F02M 61/12

USPC ..... 239/585.5, 533.12, 533.8, 533.9, 585.1, 239/584, 5, 96

See application file for complete search history.

(56) References Cited

U.S. PATENT DOCUMENTS

| | | | | |
|---|---|---|---|---|
| 4,948,049 A * | 8/1990 | Brisbon | F02M 45/00 239/91 |
| 4,979,674 A * | 12/1990 | Taira | F02M 57/025 123/467 |
| 5,893,350 A * | 4/1999 | Timms | F02M 45/04 123/467 |
| 6,070,618 A | 6/2000 | Iwabuchi | |
| 6,394,072 B1 * | 5/2002 | Yoshida | F02M 47/00 123/496 |

(Continued)

*Primary Examiner* — Steven J Ganey
*Assistant Examiner* — Juan C Barrera
(74) *Attorney, Agent, or Firm* — Alix, Yale & Ristas, LLP

(57) ABSTRACT

A needle type fuel injector has a needle control chamber at a pressure subject to a control valve in a control valve chamber which in an opening phase is lifted from its seat to expose the control valve chamber, connecting passage, and needle control chamber to a low pressure drain and in a closing phase is urged against the seat to isolate the control valve chamber, connecting passage, and needle control chamber from the drain. The potential for cavitation at high fuel injection pressure is reduced by throttling the flow of fuel past the control valve seat when the control valve opens, thereby maintaining sufficient back pressure in the control valve chamber and upstream connecting passages.

18 Claims, 10 Drawing Sheets

(56) References Cited

U.S. PATENT DOCUMENTS

| | | | | |
|---|---|---|---|---|
| 6,776,190 | B2 * | 8/2004 | Schoepke ..... | F02M 47/027<br>137/625.27 |
| 7,188,782 | B2 * | 3/2007 | Magel ..... | F02M 57/025<br>239/533.2 |
| 2012/0285417 | A1 | 11/2012 | Kim et al. | |
| 2012/0325926 | A1 | 12/2012 | Moore et al. | |

* cited by examiner

LOW PRESSURE CONDITION

| | | | BASE DESIGN | CONFIGURATION 1 | CONFIGURATION 2 | CONFIGURATION 3 |
|---|---|---|---|---|---|---|
| | Pressure | P1 | 300 | 300 | 300 | 300 |
| | Pressure | P2 | 300 | 300 | 300 | 300 |
| | Pressure | P3 | 185 | 185 | 185 | 185 |
| | Pressure | P4 | 16 | 65 | 26 | 55 |
| | Pressure | P5 | N/A | 50 | 11 | N/A |
| | Pressure | P6 | N/A | 40 | N/A | 40 |
| | Pressure | P7 | 0.345 | 0.345 | 0.345 | 0.345 |
| | Pressure | P8 | 0.345 | 0.345 | 0.345 | 0.345 |

HIGH PRESSURE CONDITION

| | | | BASE DESIGN | CONFIGURATION 1 | CONFIGURATION 2 | CONFIGURATION 3 |
|---|---|---|---|---|---|---|
| | Pressure | P1 | 2000 | 2000 | 2000 | 2000 |
| | Pressure | P2 | 2000 | 2000 | 2000 | 2000 |
| | Pressure | P3 | 1251 | 1251 | 1252 | 1251 |
| | Pressure | P4 | 106 | 213 | 174 | 145 |
| | Pressure | P5 | N/A | 110 | 70 | N/A |
| | Pressure | P6 | N/A | 40 | N/A | 40 |
| | Pressure | P7 | 0.345 | 0.345 | 0.345 | 0.345 |
| | Pressure | P8 | 0.345 | 0.345 | 0.345 | 0.345 |

DESIGN CONFIGURATION

| | | BASE DESIGN | CONFIGURATION 1 | CONFIGURATION 2 | CONFIGURATION 3 |
|---|---|---|---|---|---|
| | | | | | |
| | Throttling Feature | | Yes | Yes | No |
| | Regulator Feature | | Yes | No | Yes |

Fig. 10

METHOD OF SUPPRESSING CAVITATION IN A FUEL INJECTOR

RELATED APPLICATION

This is a Divisional of U.S. patent application Ser. No. 13/792,622, filed Mar. 11, 2013, for Anti-Cavitation Throttle for Injector Control Valve.

BACKGROUND

The present invention relates to diesel engine fuel injectors of the type wherein a solenoid valve controls the pressure in a chamber acting on a needle injection valve.

In these types of injectors, the control valve acts as a normally closed valve in a control chamber to separate fuel in a needle control chamber and associated passages at high pressure from a region of low pressure. A spring or the like on the solenoid armature or stem, urges a shaped pintle or the like against a commensurately shaped control chamber seat. The injection event is initiated by energizing the solenoid, which lifts the control valve off its seat, thereby connecting the high pressure fuel in the needle control chamber and passage to the low pressure region or sump and in a known manner lifts the injection needle off its seat at the bottom of the injector body. The lifting needle exposes injection orifices at the tip of the body to high pressure fuel, and thereby starts the injection event.

If changes occur in the control valve, such as valve stroke change or seat leakage, fuel delivery to the engine will change. Changes in fuel delivery result in changes to engine power and exhaust. This undesirable effect can cause the engine to become overloaded by excess fuel and out of compliance with emission regulations. All injector control valve seats will exhibit some wear over the life of the injector. The control valve seat is exposed to high velocity fluid and high contact stresses when the control valve shuts against the control valve seat.

To operate at very high injection pressures associated with common rail fuel systems, the pintle of the injector control valve must be pushed into its seat by a high enough spring load to assure that it seals. Such spring load accelerates the control valve into the seat. The resulting contact stresses can be very high when the valve closes onto the seat. Higher injector seat stresses produce accelerated wear, resulting in increased seat leakage which eventually requires replacement of the entire injector.

High injector pressures also increase the risk of cavitation damage to the valve seat and in other fluid passages of the injector upstream of the control seat. Rapid reduction of upstream fluid pressure occurs when the control valve opens, producing bubbles. Upon re-pressurization after the control valve closes, such bubbles collapse. Collapsing bubbles focus streams of fuel onto the metal surfaces in the injector with enough energy to implode on the metal surface, causing damage.

The present invention addresses the problem of cavitation at high fuel injection pressure.

SUMMARY

The improvement comprises providing a restriction downstream of the control valve seat sufficient to prevent cavitation from occurring upstream of the control valve seat when the control valve opens.

Such means resist fuel flow in the closing direction through the control valve seat toward the drain as the control valve opens, thereby maintaining higher pressure upstream of the control valve sea. This prevents vapor bubbles from forming while the control valve is open, so no bubbles can collapse and cause damage upon re-pressurization when the control valve closes.

An annular flow collar or the like can be tuned to achieve enough throttling of flow as the control valve opens to avoid upstream vapor bubble formation but not so much throttling that the time interval to end of injection is excessively slowed.

Providing a collar on an extension or nose of the control valve pintle downstream of the control valve seat is one technique for achieving a predictable and constant throttling effect over the life of the control valve. This directs and throttles flow through an annular flow path between the collar and the surrounding passage wall. Such technique is passive, in the sense that there are no moving parts other than the normal reciprocation of the control valve.

Although providing a pressure regulated volume downstream of the control valve for slowing down the control valve closure rate can also help reduce cavitation upstream of the control valve seat and providing a throttle for maintaining backpressure upstream of the control valve seat when the control valve opens can also help slow down the valve closure rate, optimum performance is achievable by using a combination of the two techniques.

Whereas regulation of the pressure downstream of the control valve seat for slowing down the valve closure rate is beneficial at all fuel pressure operating conditions, cavitation is not a problem at low fuel system pressure, so the throttling of flow past the control valve seat can be optimized for operation at high fuel system pressure.

The addition of a throttling feature on the nose of the control valve facilitates optimization by permitting design of the throttle primarily for cavitation control with secondary effect on slowing down valve closure, and optionally including a pressure regulator primarily for slowing down valve closure with secondary effect on cavitation control.

BRIEF DESCRIPTION OF THE DRAWING

FIG. 10 is a Table showing the fuel pressure at various locations in the fuel system according to the schematics of FIGS. 9A and 9B;

DETAILED DESCRIPTION

Figure 1:
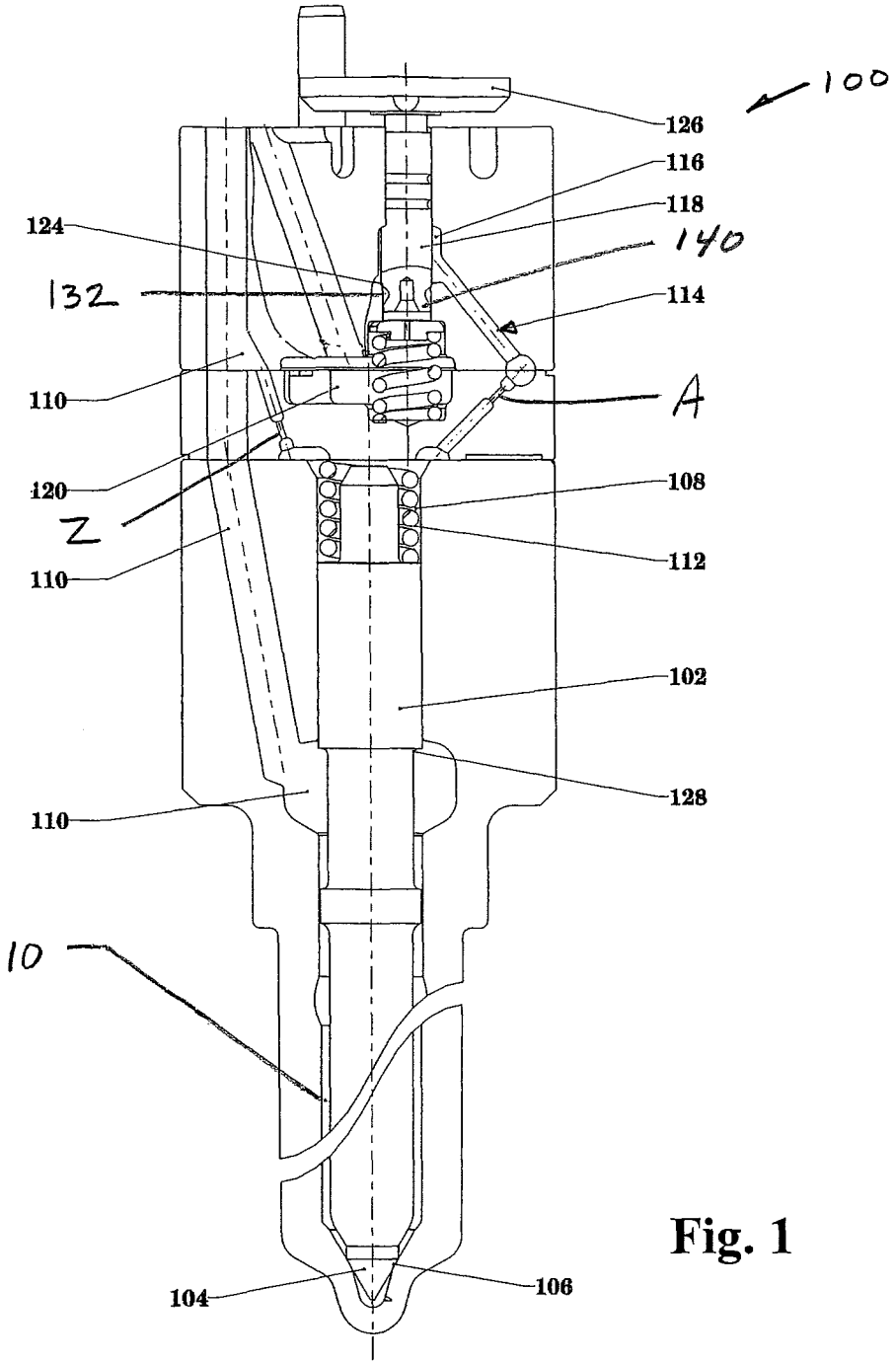
FIG. 1 is a schematic view of a fuel injector that embodies an aspect of the present invention.
Figure 2:
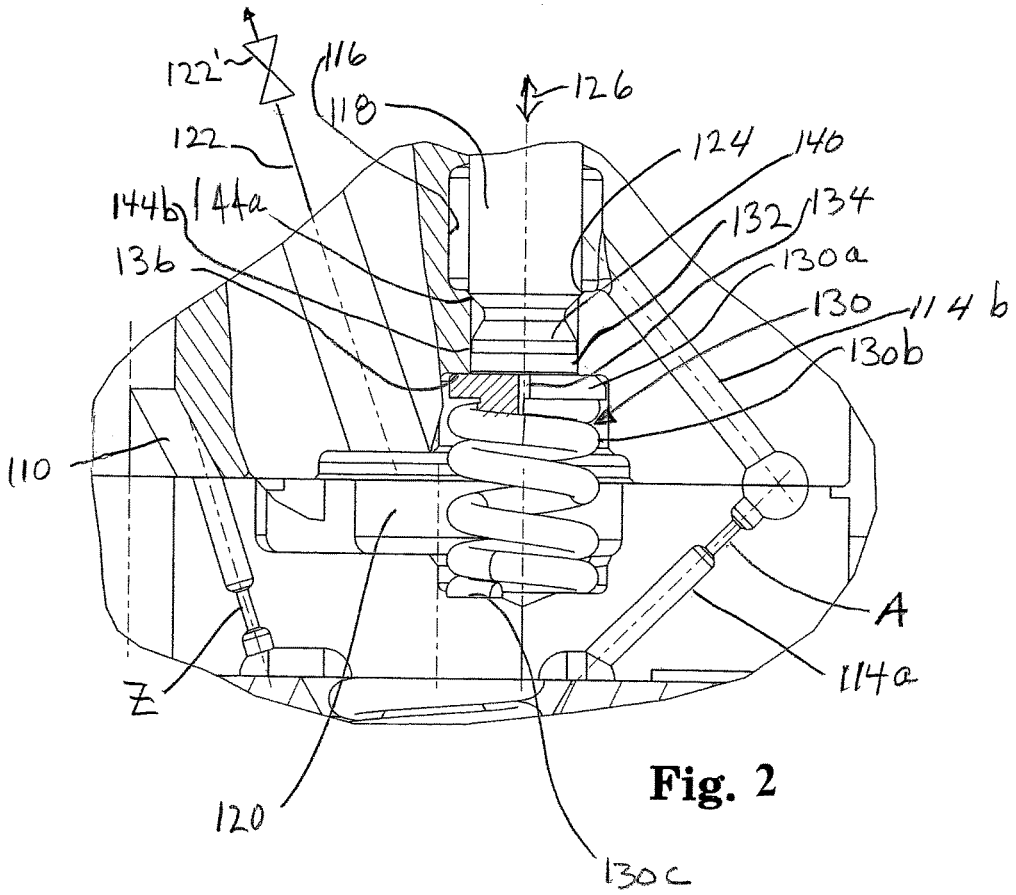
FIG. 2 is a detail view of a portion of FIG. 1.

FIGS. 1 and 2 show one embodiment of an injector 100 having a needle valve 102 with tip 104 that engages a seat 106 in the injector body during a closed condition between injection events. In this closed condition, a needle control chamber 108 is supplied with high pressure fuel 110 from a high pressure supply pump (not shown) and likewise the same high pressure fuel 110 is supplied to an annular surface 128 at an intermediate position on the needle. Due to the area differences, the fluid pressure force on the injection needle is substantially higher at the control chamber 108 at the upper end of the needle. The needle is held against the seat 106 as a result of this net downward hydraulic force as supplemented by the spring 112 in the chamber 108.

A fluid path 114*a, b* connects the high pressure needle control chamber 108 with a control valve chamber 116. The control valve 118 has a stem-like pintle with a generally conical sealing area which when seated at 124 separates the high pressure existing in 108, 114, and 116, from a low pressure sump, e.g., via pump inlet or return line 122. Preferably, a low pressure chamber 120 can be provided between the seat 124 and the return line 122.

Flow restrictors or orifices "Z" can be provided in the high pressure line 110 leading to the needle control chamber 108 and "A" between the passages 114*a, b* from the needle control chamber 108 to the control valve chamber 116.

A solenoid actuated armature 126 selectively lifts the control valve 118 off seat 124 thereby exposing the chamber 108 to the low pressure sump 122 via path 114, 116, and 120. The reduced pressure in chamber 108 enables the continued presence of the high pressure at the lower surface 128 of needle 102 to overcome the spring 112 and thereby lift the nose 104 from seat 106 and inject high pressure fuel that surrounds the lower portion of the needle.

The present invention will be described in the context of various combinations with a pressure regulating valve for slowing down the closure rate of the control valve, but it should be understood that the benefit of suppressing or eliminating cavitation can be achieved by many kinds of flow restrictions downstream of the control valve seat. For example, so long as they increase the back pressure upstream of the control valve seat sufficiently during opening of the control valve, an orifice, a pressure regulating valve, or a throttling collar, taken alone or in combination, can fall within the scope of the present invention.

According to FIGS. 1 and 2, flow resistance or restricting means 130 are provided downstream of the seat 124 of the control chamber 116, to control the time dependent pressure in a pressure regulated volume 132 immediately downstream of the seat 124. The restriction produces sufficient back pressure to slow down the engagement of the control valve 118 against seat 124, while keeping this back pressure low enough so as not to unduly resist the prompt re-seating of the control valve 118 onto seat 124. This objective is difficult to achieve because of the need to accommodate a range of high pressure fuel in the common rail (and thus a range of differential pressure between chamber 116 and chamber 132) as well as a range of injection frequencies (i.e., injection events per unit time). The pressure regulated volume 132 preferably has a cross sectional area approximately that of the outlet of the control chamber 116 at seat 124 and is provided immediately upstream of low pressure chamber 120 (considering flow direction from chamber 116 toward return or drain line 122).

In a target operating context, the fuel pressure in needle control chamber 108, passages 114*a, b* and control chamber 116 can be in the high range of 2000-3000 bar down to a low range of 200-300 bar, with steady state pressure typically at least 1200 bar. With the present invention, fuel flow past seat 124 to substantially ambient pressure at 120 during operation in the high pressure range is resisted so that the upstream pressure in chamber 116 and passages 114*a, b* is maintained well over 100 bar. The restriction is designed so that fuel flow past the seat 124 during operation in the low pressure range will result in maintaining a pressure in upstream passages well above 50 bar without adversely affecting the reseating of piston 118.

If a low pressure check or bypass valve 122' is provided in the drain 122 to prevent the drain pressure from dropping below about 5 psi, the amplitude of the pressure pulses in the pressure regulated volume 132 and upstream passages 114 *a, b* can be reduced considerably. One such valve 122' can be located at the downstream end of a common drain in fluid communication with the low pressure chambers 120 from all the injectors.

It can thus be understood that the pressure regulated volume 132 is situated in fluid communication between the valve seat 124 and the low pressure sump 122. A pressure regulating valve 130 is located in low pressure chamber 120, which regulating valve opens to permit flow from the control chamber 116 through the regulated volume 132 and low pressure chamber 120 to the low pressure sump 122 in response to rising fluid pressure from the lifting of the control valve 118 and closes to prevent flow from the control chamber 116 through the regulated chamber 132 to the low pressure sump in response to decreasing fluid pressure from the closing of the piston valve 118. The regulating valve 130 opens after the piston valve 118 opens and the regulating valve closes after the piston valve 118 closes, thereby providing a diminishing back pressure on the piston valve 118 as the piston valve closes against its seat 124.

As used herein, "pressure regulating valve" should be broadly understood as a device that is designed to hold a fluid pressure in an associated pressure regulated chamber or volume.

In the embodiment shown in FIG. 2, the pressure regulating valve 130 is a plate valve having an upper disc-like portion 130*a* with a coil spring 130*b* seated on the plate 130*a* and against a recess in wall of chamber 120 at opposite end 130*c*, urging portion 130*a* against shoulder or similar seat 136 at the upstream face of the low pressure chamber 120. The fluid in the regulated volume 132 can escape through orifice 134 in plate 130*a* and thereby relieve any residual pressure that may be present in the regulated volume 132 when the regulating valve 130 has re-seated at 136. In FIG. 2 the orifice 134 is shown as part of the plate valve 130*a*, but other restrictive flow paths could be provided, for example, through a wall of the pressure regulated chamber 132 or low pressure chamber 120.

Figure 3:
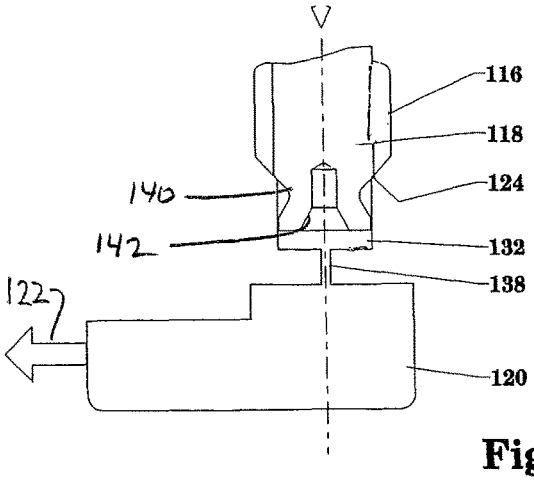
FIG. 3 is a schematic view of an alternative context for implementing the present invention.

FIG. 3 shows one such example in a more generalized embodiment in which the control chamber 116 and associated control valve 118 interact with the seat 124 and the regulated volume 132 is in fluid communication with the low pressure chamber 120 which in turn is in fluid communication with the low pressure sump 122, but the difference relative to FIG. 2, is that the back pressure in regulated volume 132 can be provided only by an orifice 138 between the regulated volume 132 and the low pressure chamber 120.

Moreover, this orifice 138 also avoids residual pressure in the regulated volume 132 after the control valve 118 has closed.

It should be understood that the advantage of the arrangement of FIG. 2 relative to FIG. 3, is that the time dependent pressure profile in the regulated volume 132 as the control valve 118 closes, can be optimized through the selection of one or more of the rate of the coil spring 130*b*, the shape of the periphery of the plate 130*a*, and the profile immediately surrounding the seat 136. This optimization can accommodate a wider range of high pressure fuel in passage 114.

FIGS. 1-3 also show embodiments of anti-cavitation throttle means 140, provided on the tip or nose at the seating end of the control valve pintle 118. This feature 140 preferably extends below seat 124 into regulated volume 132 and can include a recess 142 (e.g., an in indented dome or a blind bore with or without a conical or frusto conical counterbore). This throttle means 140 substantially eliminates any cavitation and in the embodiment of FIG. 2 allows the location of the regulator valve plate 130*a* to be optimized without affecting cavitation at the control valve seat 124. The plate valve 130 and control valve throttle 140 preferably are used in combination to reduce the control valve seating velocity and reduce or eliminate cavitation damage.

The exterior of nose 140 has a smooth or stepped frustoconical angle 144*a* at its upper end for sealing against seat 124 and a downstream cylindrical collar portion 144*b* below the valve seat 124. This provides a reduction in flow area and can be considered a throttling collar 144*b* having a purposely designed clearance within the cylindrical bore wall above or defining the pressure regulated volume 132. The throttling diameter allows pressure upstream of the throttle to be increased, which increase helps avoid upstream cavitation damage, such as in passages 114*a, b*. The throttle collar 144*b* can increase upstream pressure with less effect on slowing down of the control valve 118 than the pressure regulating valve 130 and as shown in FIG. 3, can be deployed without the regulating valve 130.

Figure 4:
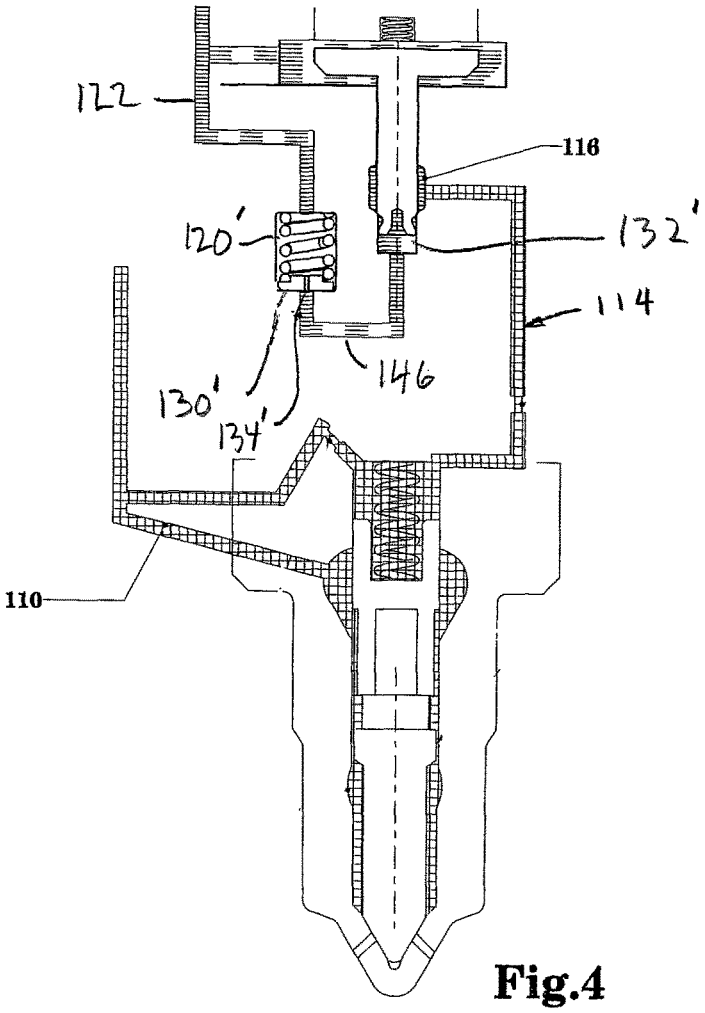
FIG. 4 is a view similar to FIG. 1, showing another context, in which the pressure regulating valve is offset from the axis of the control valve.

FIG. 4 shows another embodiment, in which the pressure regulated volume 132' includes a downstream low pressure fluid passage 146 to a restriction upstream of the low pressure return line 122. As an analog to the embodiment of FIG. 2, the restriction is a plate valve 130', biased with a spring to closure on the upstream face of a low pressure chamber 120', with an orifice 134'. However, this restriction could be a simple orifice or a biased plate without orifice.

Figure 5:
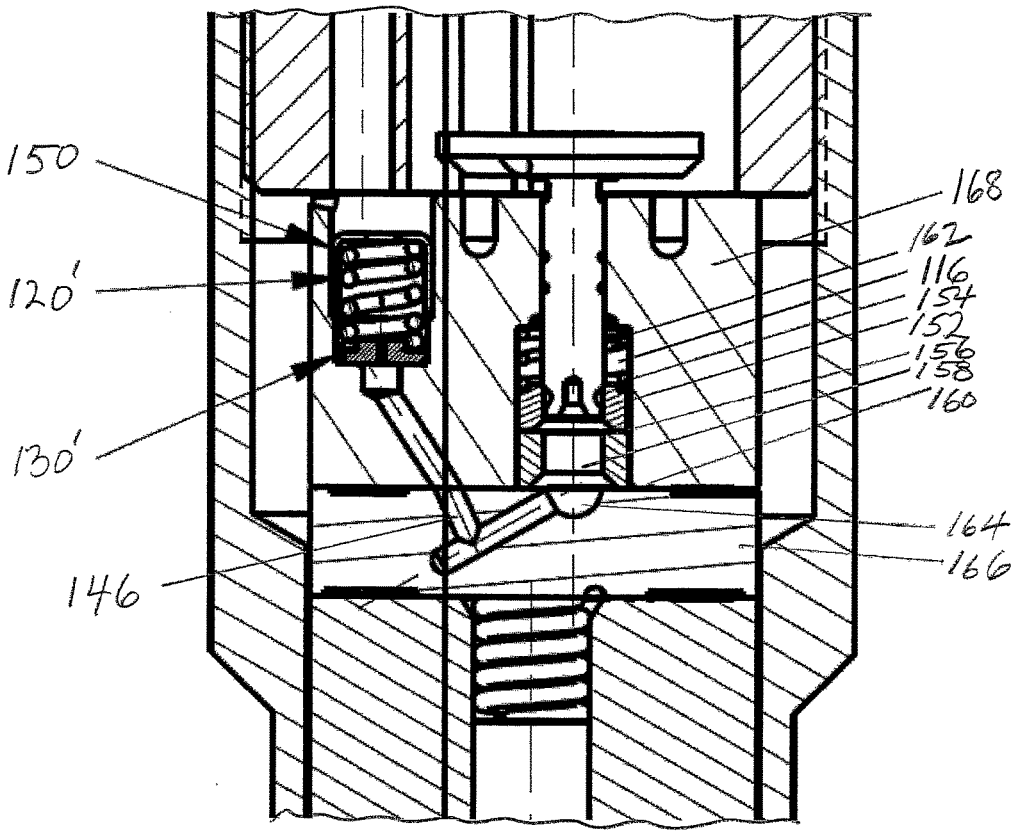
FIG. 5 shows a variation of the embodiment of FIG. 4.

FIG. 5 shows a variation of FIG. 4, incorporating a floating piston control valve seat which offers both improved alignment for the seat to the control valve and potentially improved manufacturability. The regulating valve 130' and low pressure chamber 120' downstream of passage 146 are similar to those shown and described with respect to FIG. 4. Optionally, the spring may be seated in a friction fit cup 150 or the like as a manufacturing convenience. The control valve chamber 116 has a floating control valve 152 with associated seat 154 at its upper internal edge. The floating seat 152 rests on ring 156. The bore formed by the floating seat 152 and ring 156 extends from the seat 154 through to a port 164 in the upper surface 160 of plate 166. Spring 162 in control chamber 116 bears on the top of seat 152, whereby a downward biasing force is continuous applied to the seat 152 and ring 156, such that the bottom of ring 156 seats against surface 160. The control valve pintle including extended throttling nose are as described in FIGS. 3 and 4 and relate to control seat 154 and pressure regulated chamber 158 in the same manner as described with respect to FIGS. 3 and 4. Although the seat 152 is biased by spring 162, which acts to hold the seat against the plate 166, the sealing is actually performed by the fluid pressure in control chamber 116 acting above the seat. Radial freedom is provided by radial clearance between the seat ring 156 and seat block 168. Angular freedom is accomplished with a spherical contact between the seat ring 156 and floating seat 152.

Figure 6:
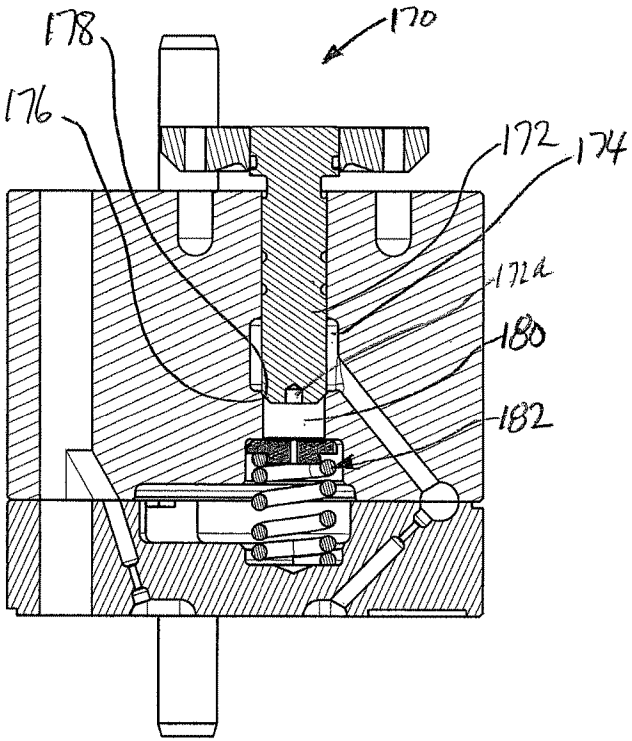
FIG. 6 shows a configuration in which the pressure regulation is provided only by a biased plate valve with orifice, without distinct throttling.

FIG. 6 shows a configuration 170, in which the control valve 172 and control chamber 174 are generally conventional. The tip of the control valve pintle 172 is tapered to seal against seat 178, but has no substantial extension into the pressure regulated volume 180. The pressure regulating function is performed by valve assembly 182 with preferred orifice and low pressure chamber and drain, as shown in FIG. 2, without distinct throttling means.

Figure 7:
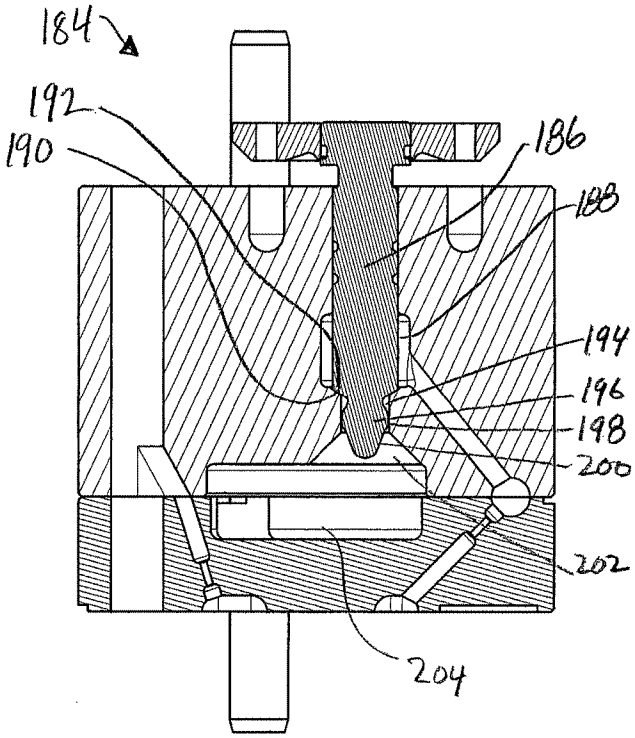
FIG. 7 shows another embodiment in which the pressure regulation and/or throttling are provided by the profile on the extended nose of the control valve pintle, without a plate valve.

FIG. 7 shows yet another embodiment 184, where the pressure regulating function is performed only by the control valve 186. Control chamber 188, sealing surface 190, and seat 192 are as shown at 174, 176, and 178 in FIG. 6. However, the pintle 186 has nose 196 that extends into the cylindrical volume 194, and cylindrical collar 198 is closely spaced from the cylindrical bore wall of volume 194. The nose 198 extends with a bullet shaped tip 200 into a conical flow volume 202 that enlarges from the end of the cylindrical volume 194. The shape of the tip also has an effect on the back pressure. As in previously described embodiments, when the control valve 186 lifts off seat 192, the fluid flow is throttled into low pressure chambers 202, 204, which in turn is in fluid communication with a sump at substantially ambient pressure.

As described with respect to FIG. 2, the low pressure chambers such as 120, 120', and 204 from each injector are connected to a common drain line and a low resistance valve between the drain line and the fuel tank provides a baseline pressure on the order of 3-10 psi in the low pressure chambers. In general, the drain includes a line from the injector to a fuel reservoir at ambient pressure and the drain line includes means for maintaining fuel at the injector drain outlet to the drain line, at a pressure of at least about 3 psi above the pressure in the reservoir.

Figure 8:
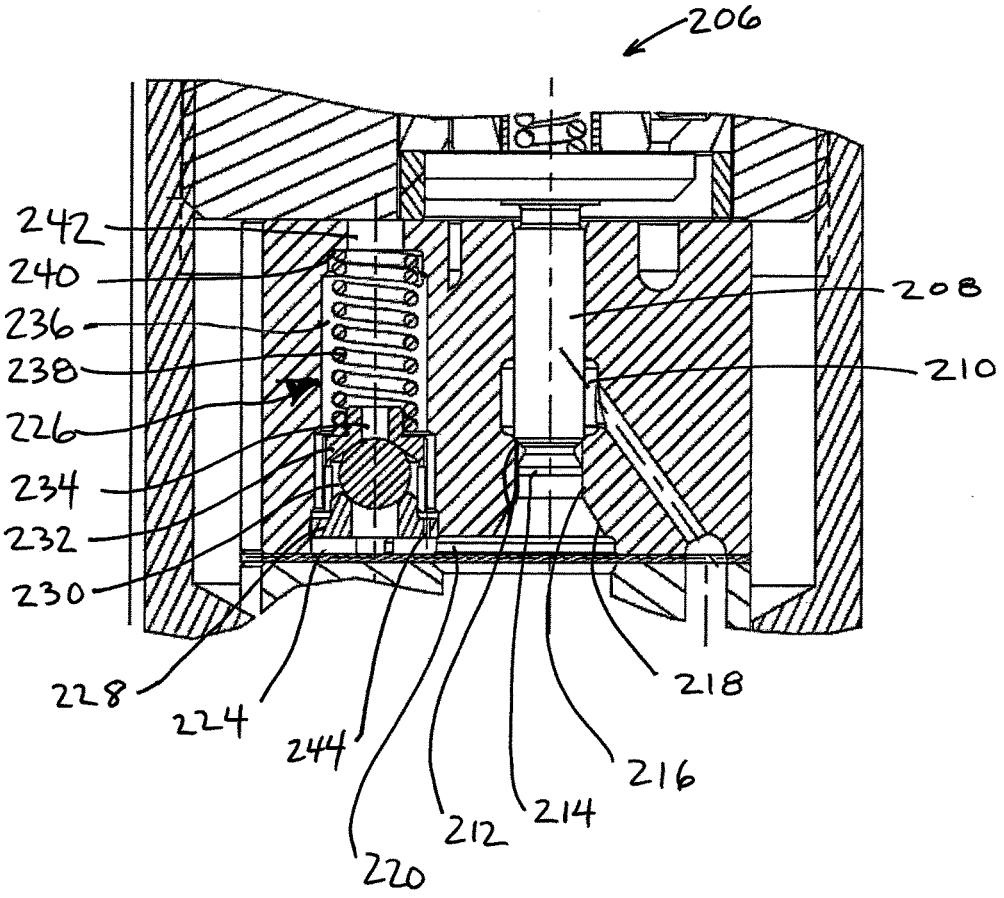
FIG. 8 shows a variation of the embodiment of FIG. 4, in which the pressure regulating valve is a ball valve.

FIG. 8 presents another embodiment 206 which incorporates features from FIGS. 4 and 7, but has a different pressure regulating valve. Pintle 208 passes through control chamber 210 for sealing against seat 212 and has an extension with cylindrical throttle collar 214 in a cylindrical volume defined by wall 216. The cylindrical portion of wall 216 immediately below the collar 214 is the operative volume of the pressure regulated volume. The cylindrical wall opens frustoconically 218 in a downstream direction where region 220 is in fluid communication with volume 224 on which the pressure regulating valve 226 directly operates.

The pressure regulating valve 226 includes an upstream valve seat 228 with central passage and associated ball 230. Ball counter seat 232 has a passage 234 leading into low pressure volume 236 where a coil spring 238 has a one bearing on seat 234 and another end bearing on a shoulder 240. The low pressure volume 236 is in fluid communication through passage 242 with the low pressure sump. The seats 228 and 232 are slidable in the entry bore region of pressure regulating valve 226. As in previously described embodiments, an orifice 244 is provided, in the upstream seat 228, in fluid communication between volume 224 and the low pressure volume 236.

Figure 9A:
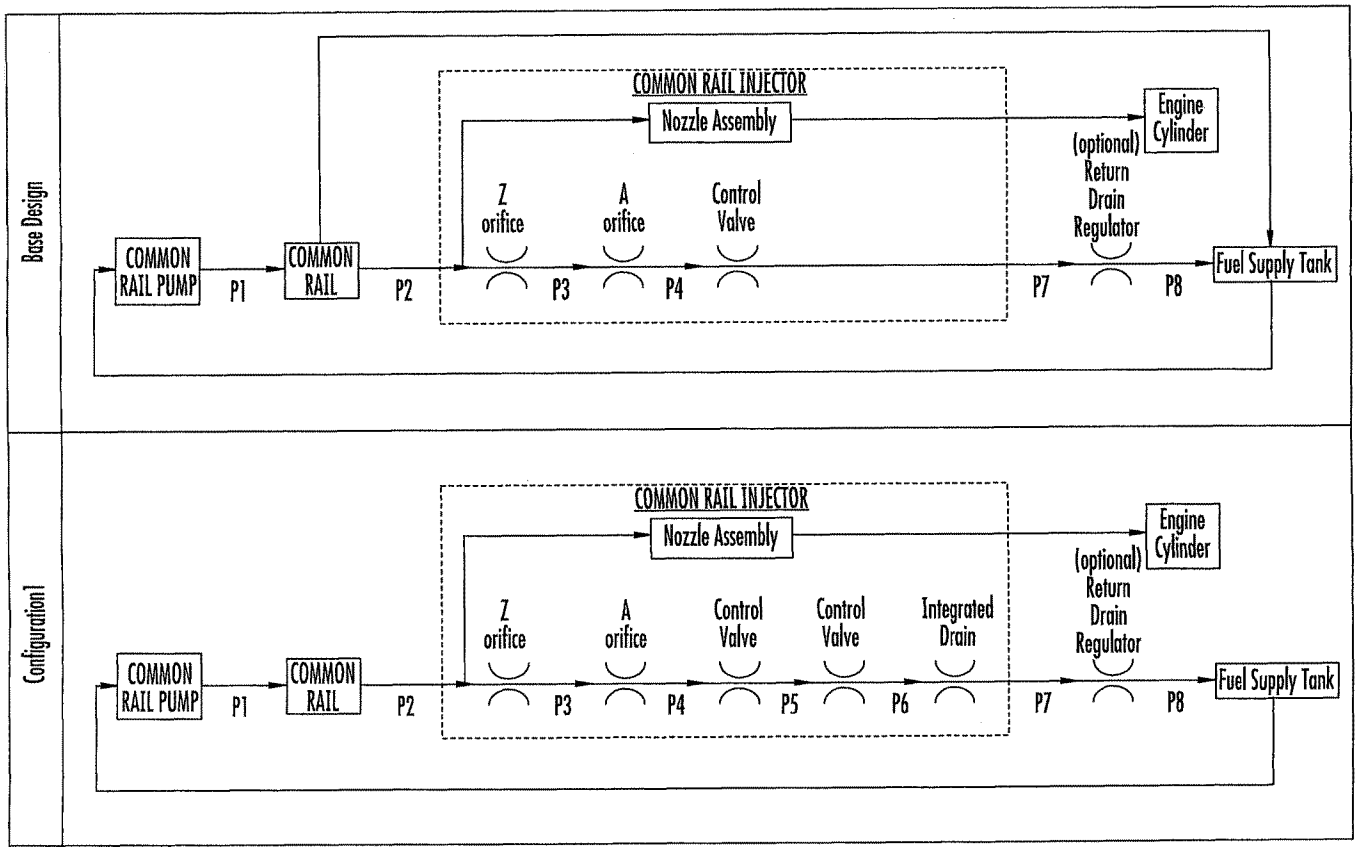
FIGS. 9A and 9B show four schematics of a fuel system in a Base design according to the prior art and three embodiments according to aspects of the present disclosure.
Figure 9B:
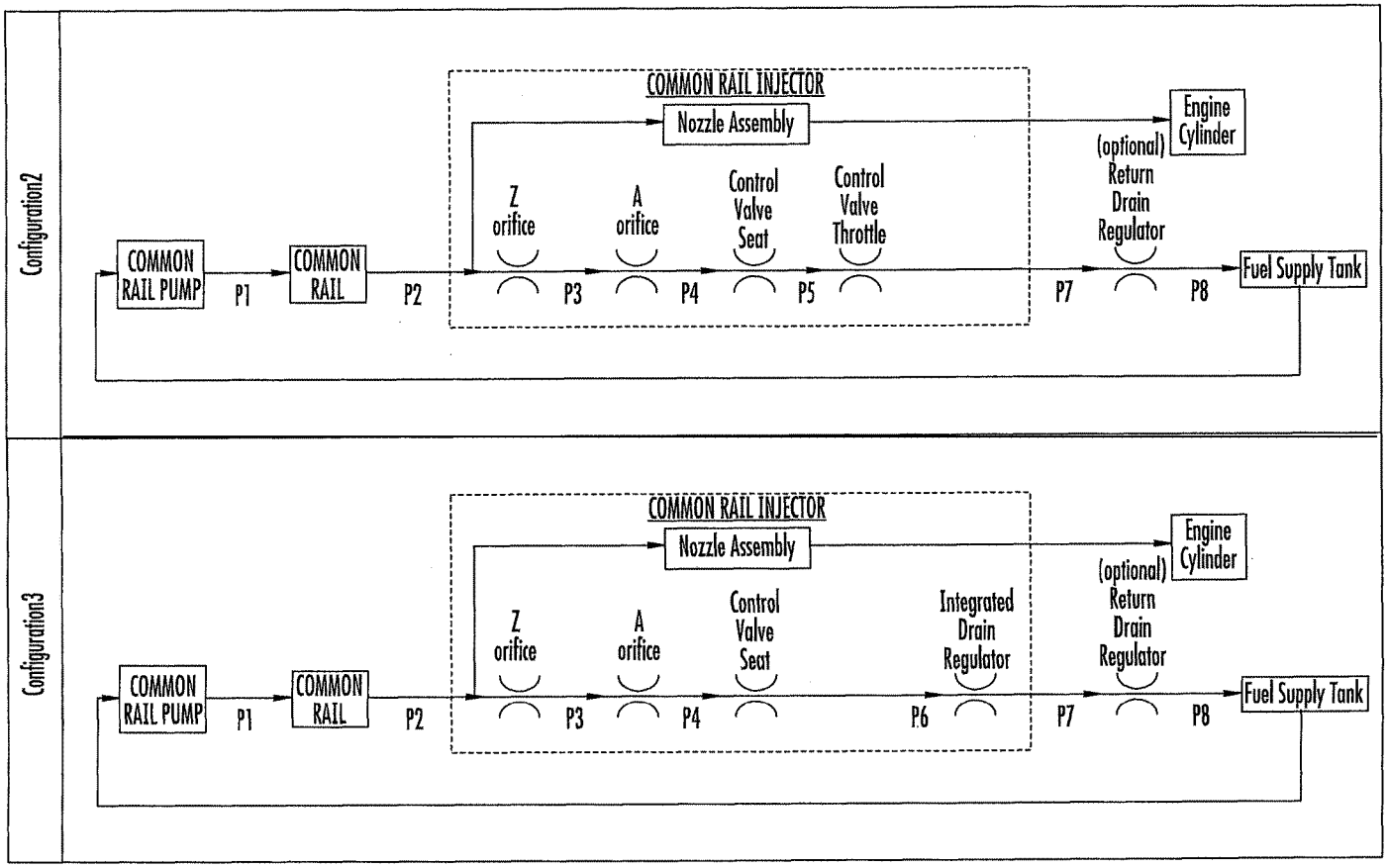

FIGS. 9 and 10 represent fuel systems, by which an integrated approach to pressure management according to embodiments of the present invention can be described and compared to a previously known base design. FIG. 9 can be related to FIGS. 2 and 3, in that the common rail pressure P2 is in high pressure passage 110; reduced pressure P3 follows orifice Z, further reduced pressure P4 follows orifice A and is the pressure at the control chamber 116. It is known that orifice A provides flow restriction for pressure management associated with the control valve.

In the Base design the pressure drops from P4 to P7 through the control valve seat 124. In the Base design, there is no significant restriction between the control valve seat 124 and the sump (fuel tank), so the pressure immediately past the control valve seat 124 is P7, the same as or slightly above the sump pressure P8. The valve seat 124 experiences a flow velocity corresponding to the pressure drop and there is no back pressure to slow down the reseating of the control piston.

However, with the present invention a flow restriction produces a pressure in the pressure regulated volume at P5 or P6>>P7 immediately past the control valve seat 124. The Table of FIG. 10 shows that with a low rail pressure of 300 bar (P2) the pressure drop P4 to P7 in the base design is about 16 bar but the pressure at P4 is only about 16 bar. In each of the three embodiments according to the present disclosure (Configurations 1-3), the pressure drop P4 to P5 or P6 is in the range of about 10-15 bar (so the flow velocity over the valve seat is somewhat similar), but the pressure at P4 remains much higher, i.e., in the range of about 26-65 bar, which helps reduce cavitation. With a high rail pressure of 2000 bar, the pressure at P4 for Configurations 1-3 remains at least about 40 bar greater than in the Base design.

The throttling feature at the pintle nose according to Configurations 2 and 3 when integrated into the Base design provides an increased operating pressure prior to pressure zone P5 which raises pressure in the injector above the fluid vapor pressure to prevent cavitation at the valve seat and spherical area after the exit of orifice A. As a result, the valve seating velocity can be decreased by varying the throttle diameter to create differential lifting area/force. A slight increase in closing delay can be measured, which is evidence of the valve slowing down.

Figure 11:
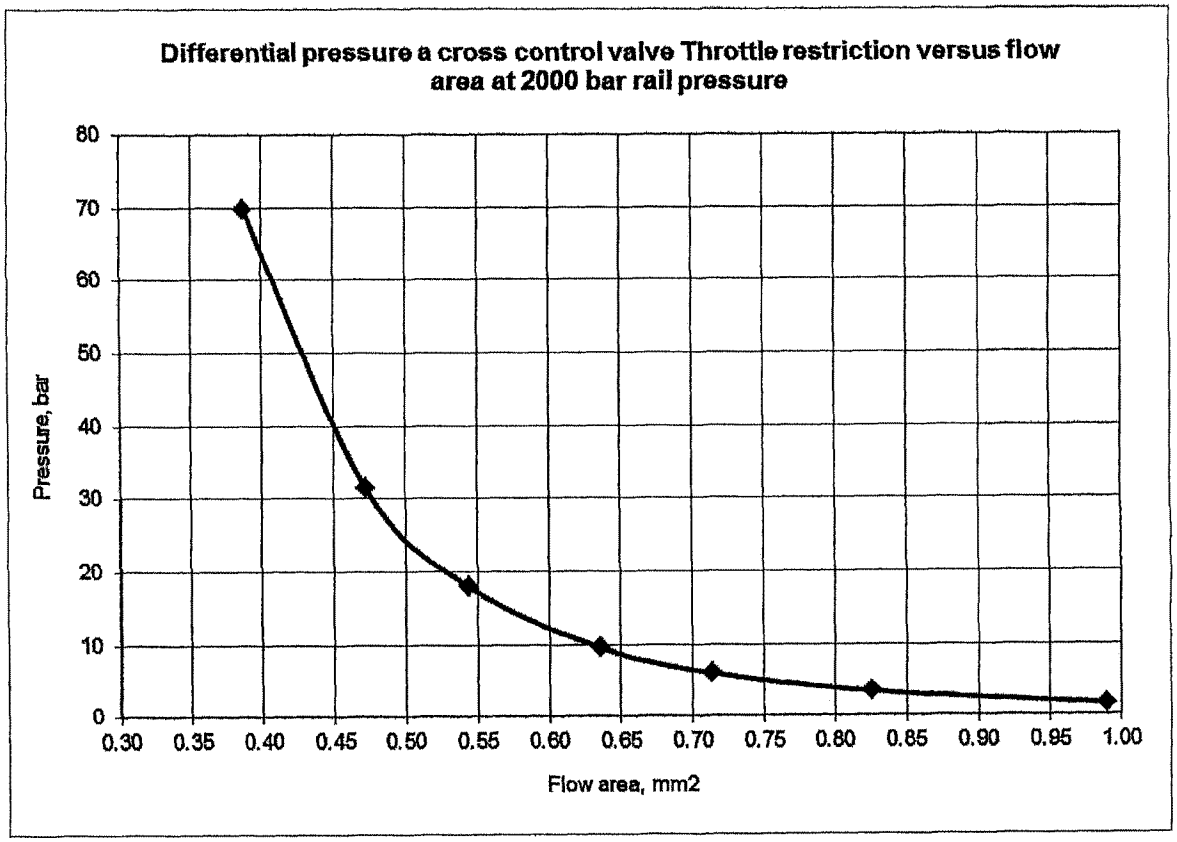
FIG. 11 is a graph showing the relationship between throttle flow area and pressure drop across the control valve seat, for a common rail pressure of 2000 bar.

The main advantage of the throttle feature is a net increase in zones P2-P5 to pressures above vapor pressure and elimination of cavitation at the seat which is located in zone P5. Conventional injectors do not have a secondary restriction that is part of the control valve. FIG. 11 (differential pressure vs. throttle area) shows that a small change in throttle flow area removes the restriction and the benefit of maintaining a high pressure P5 relative to pressure P6 is no longer achieved.

The regulator plate in the low pressure chamber which raises pressure in zone P6 (pressure regulated volume) for Configurations 1 and 3 is designed to reduce the closing velocity of the control valve. The slowing of the control valve reduces the impact velocity thus reducing the impact forces and stresses in the contact region. Zone P6 is maintained at a pressure while the valve is open and the injector is delivering fuel to the cylinder. When the control valve is commanded to close the regulator maintains pressure while the control valve opening reduces to the point when the valve closes. At the point the control valve closes, the pressure in zone 6 reaches drain pressure (0-0.5 bar). The cycle then repeats again when the valve is open. The optimum pressure under the control valve and above the regulator plate in zone P6 while the valve moves toward closure, is about 40 bar.

The invention claimed is:

1. In a method for operating a fuel injector in a diesel fuel injection system of a vehicle, including subjecting the fuel injector to a common rail fuel supply pressure, the fuel injector having a needle that closes off an injection orifice when subjected to the supply pressure at upper and lower elevations of the needle and opens when the needle is subjected to a reduced pressure at the upper elevation, the upper elevation situated in a needle control chamber that is fluidly connected by a passage to a control valve in a control valve chamber whereby in an opening phase a control valve pintle is lifted from a control valve seat to expose the control valve chamber, the passage, and the needle control chamber to a low pressure drain and in a closing phase is urged in a closing direction against the control valve seat to isolate the control valve chamber, the passage, and the needle control chamber from the low pressure drain, the improvement comprising arranging a throttling collar to the valve pintle to restrict fuel flow in the closing direction through the control valve seat as the control valve opens and placing a flow restriction in the passage upstream of the control valve chamber to thereby maintain a minimum fuel pressure in the control valve chamber and the passage between the flow restriction in the passage and the control valve chamber.

2. The method of claim 1, wherein during a range of expected operating conditions in which the common rail supply pressure varies between a relatively high supply pressure and a relatively low supply pressure, the minimum fuel pressure in the control valve chamber, the passage, and the needle control chamber is maintained throughout the opening and closing phases of the fuel injector above at least 25 bar.

3. The method of claim 2, wherein the relatively high supply pressure is 2000 bar and the relatively low supply pressure is less than 500 bar.

4. The method of claim 3, wherein during operation at the relatively high supply pressure, the minimum fuel pressure in the control valve chamber, the passage, and the needle control chamber is maintained above 145 bar.

5. The method of claim 4, wherein, during operation at the relatively high supply pressure, the fuel pressure in the control valve chamber, the passage, and the needle control chamber is maintained above 170 bar.

6. The method of claim 2, wherein the relatively high supply pressure is 2000 bar.

7. The method of claim 1, wherein restricting fuel flow in the closing direction through the control valve seat is by throttling the fuel flow below the control valve seat.

8. The method of claim 1, wherein the minimum fuel pressure in the control valve chamber and the passage between the flow restriction in the passage and the control valve chamber is above 40 bar.

9. In a method for operating a fuel injector in a diesel fuel injection system of a vehicle, including subjecting the fuel injector to a common rail fuel supply pressure, the fuel injector having a needle that closes off an injection orifice when subjected to the supply pressure at upper and lower elevations of the needle and opens when the needle is subjected to a reduced pressure at the upper elevation, the upper elevation situated in a needle control chamber that is fluidly connected by a passage to a control valve in a control valve chamber in hydraulic communication with the needle control chamber exposed to a fuel at the common rail fuel supply pressure, whereby during an opening phase, a control valve pintle is lifted from a control valve seat to expose the control valve chamber, the passage, and the needle control chamber to a low pressure drain through a flow passage extending from the control valve seat to the low pressure drain and in a closing phase is urged in a closing direction against the control valve seat to isolate the control valve chamber, the passage, and the needle control chamber from the low pressure drain, the improvement comprising restricting a fuel flow through the control valve seat using a throttling collar on the control valve pintle as the control valve opens and placing a flow restriction in the passage upstream of the control valve chamber to thereby maintain a minimum fuel pressure in the control valve chamber and the passage between the flow restriction in the passage and the control valve chamber above 40 bar during the opening phase.

10. The method of claim 9, wherein during a range of expected operating conditions in which the common rail fuel supply pressure varies between a relatively high supply pressure and a relatively low supply pressure, the fuel flow rate at the control valve seat is regulated by the movement of the control valve pintle during the opening phase so as to achieve a controlled time dependent drop in fuel pressure in the control valve chamber.

11. The method of claim 9, wherein during a range of expected operating conditions in which the common rail fuel supply pressure varies between a relatively high supply pressure and a relatively low supply pressure, the minimum fuel pressure in the control valve chamber, the passage, and the needle control chamber is maintained throughout the opening and closing phases of the fuel injector above at least 25 bar.

12. The method of claim 11, wherein the relatively high supply pressure is 2000 bar and the relatively low supply pressure is less than 500 bar.

13. The method of claim 12, wherein during operation at the relatively high supply pressure, the minimum fuel pressure in the control valve chamber, the passage, and the needle control chamber is maintained above 145 bar.

14. The method of claim 13, wherein, during operation at the relatively high supply pressure, the minimum fuel pressure in the control valve chamber, the passage, and the needle control chamber is maintained above 170 bar.

15. The method of claim 11, wherein the relatively high supply pressure is 2000 bar.

16. The method of claim 9, wherein the fuel flow through the control valve seat is restricted by throttling the fuel flow through a flow restriction below the control valve seat.

17. The method of claim 16, wherein the flow restriction is defined at least in part by a portion of the pintle which extends downstream of the control valve seat and into the flow passage.

18. The method of claim 17, wherein said portion of the pintle rises during the opening phase, the flow restriction is further defined by a wall portion of the flow passage, and the rising of the portion of the pintle during the opening phase regulates a varying resistance to flow through the flow restriction.

* * * * *